US005111648A

United States Patent [19]

Isoard

[11] Patent Number: 5,111,648

[45] Date of Patent: May 12, 1992

[54] APPARATUS FOR INITIATING THE FEED OF YARN IN A YARN PROCESSING MACHINE

[75] Inventor: Bernard Isoard, Ecully, France

[73] Assignee: Devtex, France

[21] Appl. No.: 557,193

[22] Filed: Jul. 24, 1990

[30] Foreign Application Priority Data

Jul. 27, 1989 [FR] France ..... 89 10391

[51] Int. Cl.[5] ..... D01H 5/00

[52] U.S. Cl. ..... 57/261; 57/280

[58] Field of Search ..... 57/269, 278, 279, 280, 57/85, 261

[56] References Cited

U.S. PATENT DOCUMENTS

| | | | |
|---|---|---|---|
| 3,688,486 | 9/1972 | Bell et al. | 57/269 X |
| 3,911,661 | 10/1975 | Naylor | 57/280 X |
| 4,185,450 | 1/1980 | Moruzzi et al. | 57/280 X |
| 4,235,071 | 11/1980 | Dillon | 57/280 X |
| 4,817,843 | 4/1989 | Sano | 57/279 X |
| 4,893,461 | 1/1990 | Artzt et al. | 57/280 X |
| 4,959,952 | 10/1990 | Kato et al. | 57/280 X |

FOREIGN PATENT DOCUMENTS

| | | | |
|---|---|---|---|
| 1542261 | 10/1968 | France . | |
| 2619831 | 3/1989 | France . | |
| 8703310 | 6/1987 | PCT Int'l Appl. . | |
| 2059453 | 4/1981 | United Kingdom . | |
| WO80/01288 | 6/1980 | World Int. Prop. O. | 57/280 |

OTHER PUBLICATIONS

"Ending Device for Bind-Spinning" vol. 9, No. 71(C-272) Nov. 1984.

"Threading In Air-Spinning Process": vol. 9, No. 283(C-313) Jul. 1985.

*Primary Examiner*—Joseph J. Hail, III

*Attorney, Agent, or Firm*—Wall and Roehrig

[57] ABSTRACT

A method and apparatus for initiating feed of yarn on a machine for taking yarn from a supply, processing it and rewinding it. A short length of processed yarn is led back through a series of guide wires to a vacuum receiver for holding the free end of the yarn. The wire guides are actuated to form a large loop so that the processed yarn will be fed over the input roller and the output roller, so as to pick up yarn from the supply. The lower roller of the feed roller assembly is elongated to aid in the looping and lateral in-feeding of the processed yarn loop. The previously processed yarn, after it is fed around the input and output rollers and has picked up the additional yarn to be processed is pulled from the vacuum retaining system and incorporated in the processed yarn.

7 Claims, 7 Drawing Sheets

APPARATUS FOR INITIATING THE FEED OF YARN IN A YARN PROCESSING MACHINE

The manufacture of yarns, this term being taken in its broadest sense and designating both spun fiber yarns and continuous-filament yarns or any combination of these types of materials, entails successive transformations which, in order to be realized, require equipment in which, starting from a supply source, generally stationary, the raw material originating from this source is unwound inside an appropriate treatment unit as a function of the transformations which it is desired for it to undergo and the treated material is then received at the exit of this unit. The reception of the material takes place, for example, in the form of bobbins by accumulation inside a cap . . . During the passage of the raw material inside the treatment unit, it is imperative that it unwinds at a constant speed and in order to effect this, yarn delivery roller systems are arranged, generally upstream and downstream from said treatment unit, which frequently consist of units comprising a drive cylinder against which a pressing cylinder or roll is applied, the textile material passing between these two elements and being pulled along at a given speed.

The majority of those pieces of equipment currently on the market for transforming yarns are in the form of units comprising a plurality of identical work positions arranged side by side on a common frame, the treatment members, and in particular the yarn delivery roller systems and the transformation unit arranged between them, being more often than not mounted beneath each other, the yarn delivery roller systems essentially consisting of shafts extending over the entire length of the machine and common to all the work positions and against which the pressing cylinders or rolls bear. Among well known examples of such types of machines designed in this way, there may be mentioned false twisting texturing machines, twisting machines or any other similar equipment.

When such types of equipment are employed, one of the problems which arise is that of restarting a work position, for example when the receiving bobbin is full and must be replaced with an empty bobbin or when it is necessary to service the machine during the manufacturing process, for example after the yarn has broken.

These restart operations have for a long time now been carried out manually by reintroducing in this way a length of formed yarn successively inside each of the members of the machine and this is done in accordance with the manufacturing process, in other words by introducing the yarn firstly inside the first delivery roller system, then the transformation unit, then inside the delivery roller system arranged at the exit of this transformation unit and lastly onto the winding unit.

Since a manual restart of this type entails a loss of productivity and is awkward to carry out, it has been proposed for a long time now to automate it. The solutions proposed for effecting such an automation have, obviously, consisted simply in performing automatically the same operating stages as those performed manually, which results in complex units which are awkward to employ.

Now it has been found, and this is what forms the subject of the present invention, that it was possible to overcome these restart problems and to be able to carry out easy automation in a simple and effective manner:

on the one hand by arranging, for each work position, the unit consisting of the two delivery roller systems and the yarn-treatment member arranged between these delivery roller systems in a given manner on the frame of the machine;

and in adapting these elements such that the restart operation may take place in accordance with a simple and novel method which also forms part of the invention.

In the description which follows, for the sake of simplicity, the novel type of textile machine according to the invention as well as the novel restart method which is a subject of the present invention will be described for an installation in which a yarn is subjected to the action of a crossed-belt friction false twisting spindle arranged between two yarn delivery roller systems, the supply taking place from a fixed unit and the reception in the form of a bobbin. Such an example is not limiting and it is clear that the invention also relates to any type of machine including, of course, two yarn delivery roller systems between which a treatment member or unit other than a crossed-belt friction false twisting spindle is arranged but on the condition, as will be seen in the description below, that this treatment unit makes it possible that (or is adapted such that) the yarn to be treated may be introduced laterally by translation in the form of a filament held taut on either side of said element, and not axially by longitudinal traction. Lastly, as a different type of treatment member, there may, for example, be mentioned disk false twisting spindles, heat-treatment means such as heaters enabling a shrinking or other treatment of the yarn to be performed, air-treatment nozzles, etc.

Moreover, in the description which follows, the unit consisting of the two delivery roller systems and the false twisting spindle will be designated by the expression "treatment block".

In a general manner, the invention therefore relates to an improvement made to machines permitting the production and transformation of yarns (such as spinning, false twisting texturing machines, etc.), which machines comprise a plurality of work positions arranged side by side on a common support frame, each work position comprising, arranged between a yarn-supply source and a unit for receiving the treated material (in the form of a bobbin for example), a treatment block consisting of a treatment member proper arranged between two delivery roller systems each comprising a drive shaft against which a pressing roll bears, the yarn passing between these elements.

In the machine according to the invention, if a work position is considered viewed from the front, the treatment block is realized such that:

the yarn delivery roller systems are of the type having a drive roller and a pressing roll and are mounted orthogonally to the face of the machine such that the material may be introduced between them laterally;

the treatment element proper (false twisting spindle for example) arranged between these delivery roller systems is also designed so as to enable the yarn to be introduced inside said element laterally;

the feeding of the yarn to be treated inside the first delivery roller system system and its extraction when it leaves the second one takes place in the reverse direction in a vertical or substantially vertical plane, whereas its path in the treatment block is a straight line and is in a horizontal or slightly inclined plane (termed spinning plane);

a store unit with a yarn reserve is arranged beneath the plane termed "spinning plane", formed by the yarn inside the treatment block and the generatrices passing through the point of contact of said yarn when it enters and leaves the delivery roller systems, said reserve and store element being associated with a movable unit enabling the yarn to be introduced inside the elements forming the treatment block and, the yarn stored inside said reserve to be extracted simultaneously.

Moreover, in order to facilitate the introduction of the yarn inside the treatment members, in the machine according to the invention:

in each delivery roller system, one of the rollers is longer than the other and this is in order to facilitate the introduction of the yarn between said rollers; the entrance of said rollers may, moreover, be beveled so as to have a conical chamfer on its leading edge;

the reserve consists of a unit in the form of a suction tube and which is associated with a movable element sliding inside said tube, thus not only enabling the yarn to be brought into the work plane but also facilitating the taking-up of the yarn stored inside the reserve when it is introduced into the various elements of the treatment block.

Such a type of machine is particularly suitable for a novel type of start-up method which forms the subject of the present invention, said yarn start-up method, either in the event of a restart when a full bobbin of treated yarn is replaced with an empty support tube or in the event of a restart operation after a break, essentially consisting:

in taking up a length of previously formed yarn from the winding bobbin (in the case where the machine is restarted by replacing a full bobbin with an empty support tube, the latter therefore having a few turns of previously formed yarn);

in storing the yarn thus taken up from the bobbin inside the reserve arranged beneath the treatment plane between the first delivery roller system and the treatment member proper, the path of the yarn from the winding bobbin to the entrance of the reserve being such that the portion of yarn forms a loop surrounding the drive shafts of each delivery roller system of the treatment block;

in introducing the portion of yarn held taut between the two drive shafts virtually instantaneously inside each of the members, this introduction being realized, with the yarn unwinding at its treatment speed, initially by bringing the reserve yarn into contact between the drive roll and the pressing roll of the first delivery roller system and by displacing said yarn on the generatrix of said delivery roller system, which causes a variable-pitch helical displacement on the drive cylinder introducing the portion of yarn automatically and virtually instantaneously inside the treatment member proper and then inside the exit delivery roller system; and in connecting the free end of the yarn to be treated originating from the supply source to a portion of the yarn placed in reserve when it is taken up during the positioning inside the elements of the spinning block.

Although such a method may be implemented manually, it is possible for the taking-up of the yarn from the winding bobbin to be performed by means of a gun which the operator moves in order to surround the drive rollers and to bring the yarn to the entrance of the reserve, such a machine and such a method may be easily automated, either by providing on each position of the machine a unit termed "spreader" enabling the yarn to be arranged in the form of a loop about the delivery roller systems or by providing such a spreader element on a robot which may move in front of the machine and is shared by all the work positions.

The invention and the advantages which it provides will, however, be better understood from the exemplary embodiment given hereinbelow as a guide and with no limitation being implied and which is illustrated by the attached diagrams, in which.

Figure 3A:
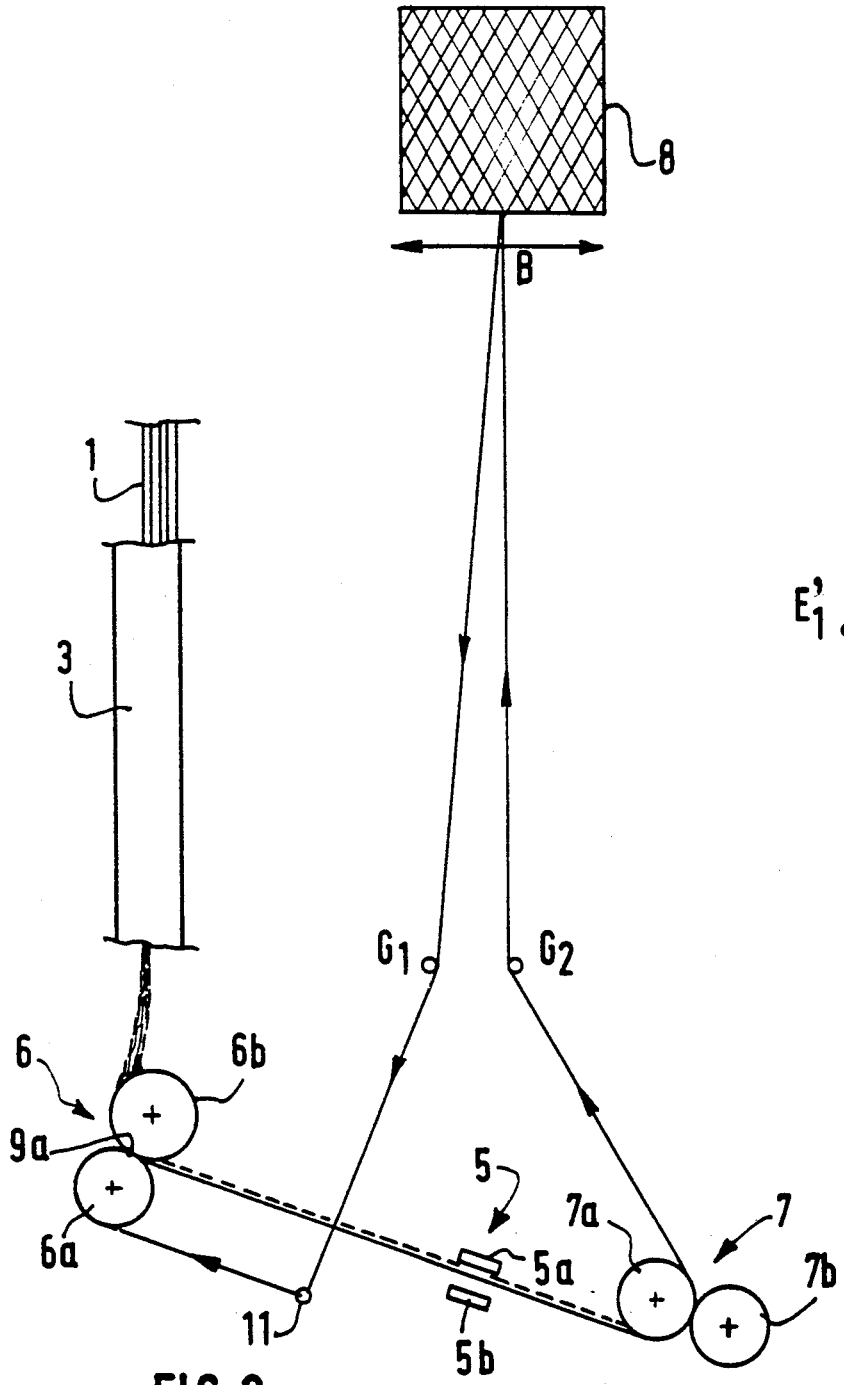
Figure 3B:
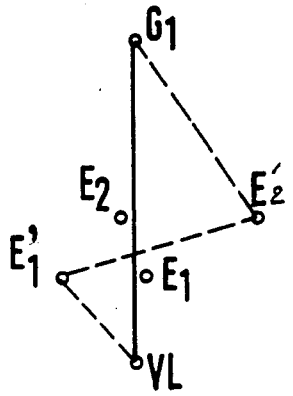
Figure 4:
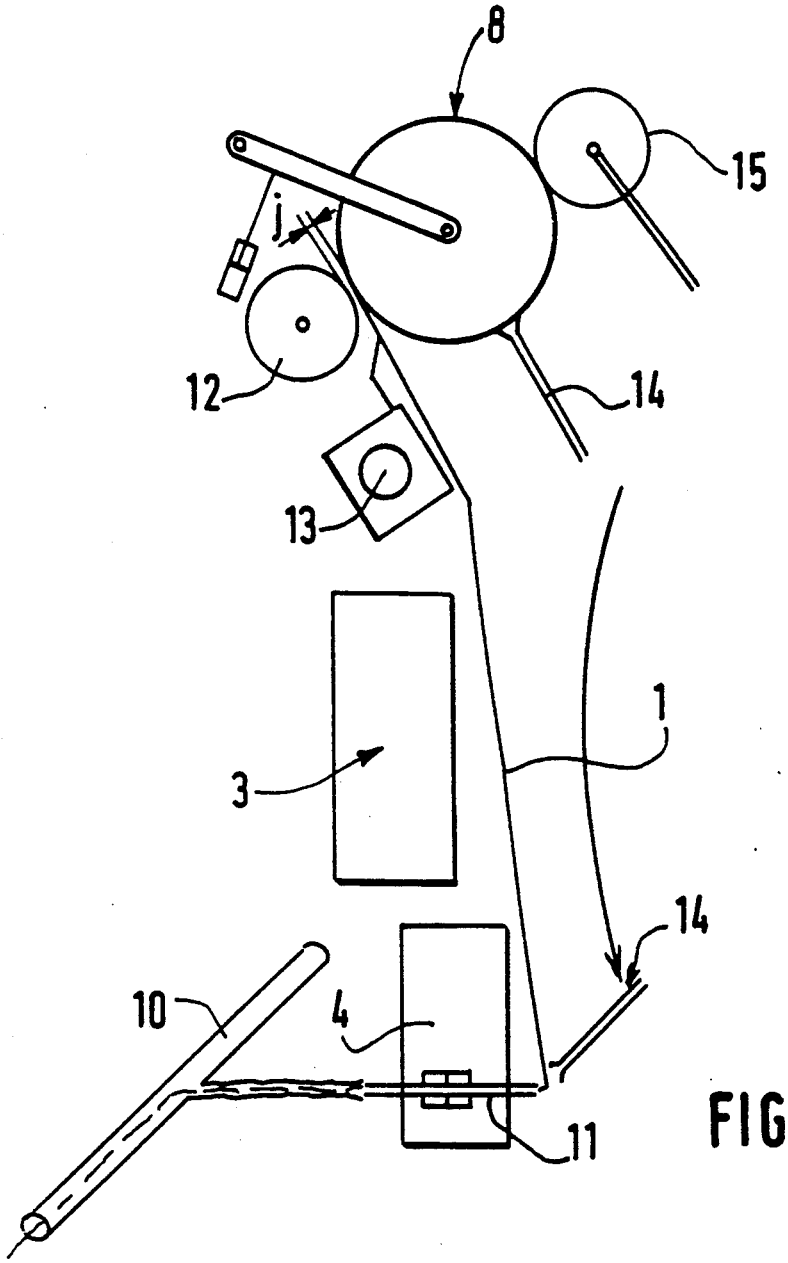
Figure 5:
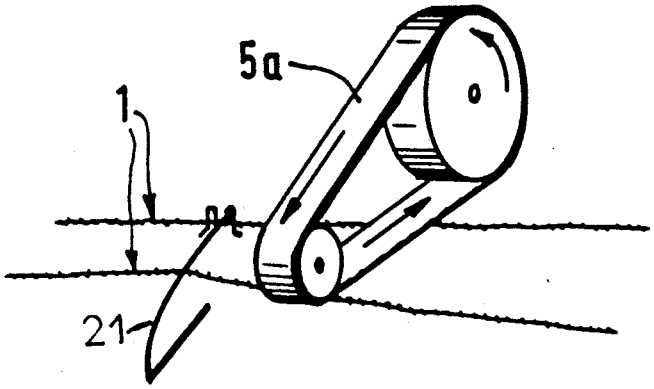

FIGS. 3*a* and 3*b* are front-view diagrams showing the manner in which the yarn is taken up from the receiving bobbin and the way in which it is positioned around the delivery roller systems during the restart operation;

FIG. 4 is a diagrammatic side view also showing the way in which the yarn may be taken up from the bobbin formed when the restart is carried out;

FIG. 5 is a diagrammatic perspective view illustrating the way in which a yarn-treatment element in the form of a belt-friction false twisting spindle may be realized facilitating the positioning of the yarn during the restart;

FIGS. 6*a* to 6*l* illustrate the entire operating procedure for restarting a work position of a machine according to the invention in which the treatment member consists of a crossed-belt friction spindle arranged between two delivery roller systems.

Figure 1:
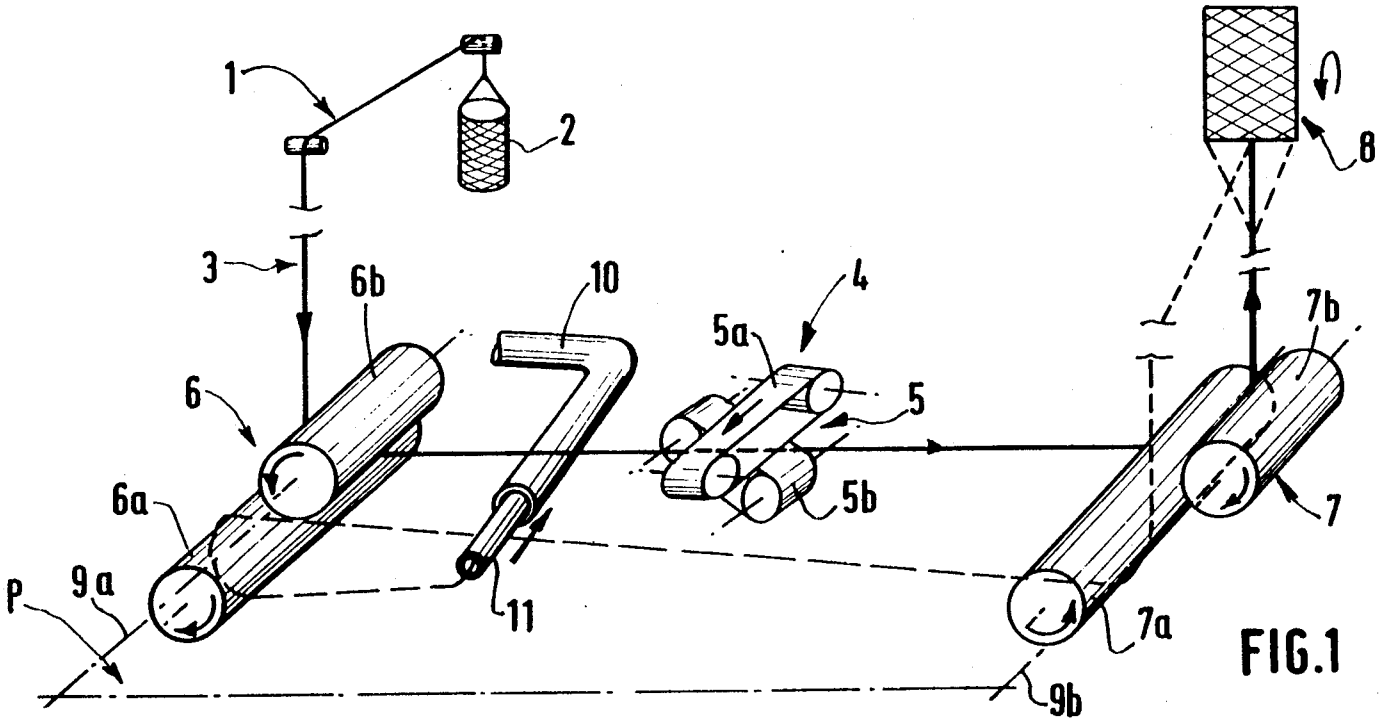
FIG. 1 is a diagrammatic perspective view of a work position of a machine in a form according to the invention.

FIG. 1 illustrates, viewed diagrammatically in perspective, a work position of a machine in which a yarn (1) originating from a supply source (2) is to be subjected, after having undergone an optional transformation in a zone (3) not shown (drafting operation for example), to a treatment inside a unit designated by the general reference (4) and which, in the present case, consists of a crossed-belt false twisting spindle (5) arranged between two yarn delivery roller systems (6, 7) in order then to be wound in the form of a bobbin (8).

In the machine according to the invention, the yarn delivery roller systems (6, 7) are of the type having drive rollers (6*a*, 7*a*) and pressing rolls (6*b*, 7*b*), it being possible for the pressing rolls to be either mounted loosely on the drive rollers or, conversely, also to be driven positively in rotation. These delivery roller systems (6, 7) are mounted orthogonally to the face of the machine such that the yarn (1) may be introduced between them laterally.

The treatment element, in the present case consisting of a crossed-belt false twisting spindle which is arranged between these delivery roller systems (6, 7), is also designed so as to enable the yarn to be introduced laterally. The spindle used will advantageously be a crossed-belt false twisting spindle of the type forming the subject of the French Pat. No. 2,619,831 (corresponding to U.S. Pat. No. 4,910,953) filed by the Applicant. Since such an element is described clearly in the abovementioned document, for the sake of simplicity it will not be mentioned in detail in the description which follows.

In the machine according to the invention, the feeding of the yarn to be treated (1) inside the first delivery roller system (6) and its extraction when it leaves the second delivery roller system (7) are realized in the reverse direction in a vertical or substantially vertical plane, whereas the path of the yarn (1) inside the treatment block (4), which path is in a straight line, is for its part realized in a plane, termed spinning plane, which is horizontal or slightly inclined, this plane P, termed spinning plane, being formed by the plane passing through the yarn inside the treatment block (4) and by the generatrices (9*a*, 9*b*) passing through the point of contact of the yarn when it enters and leaves the drive rolls (6*a*) and (7*a*) of the two delivery roller systems (6, 7).

Moreover, according to the invention, a store unit (10) with a reserve of a length of yarn is arranged beneath the abovementioned plane P, this reserve essentially consisting of a suction tube and being associated with a movable unit (11) termed "start-up jack" enabling the yarn to be introduced inside elements forming the treatment block (4) and, simultaneously, the yarn stored inside said reserve (10) to be extracted. This movable element (11) consists of a suction tube which slides inside the entrance end of the reserve (10).

Figure 2:
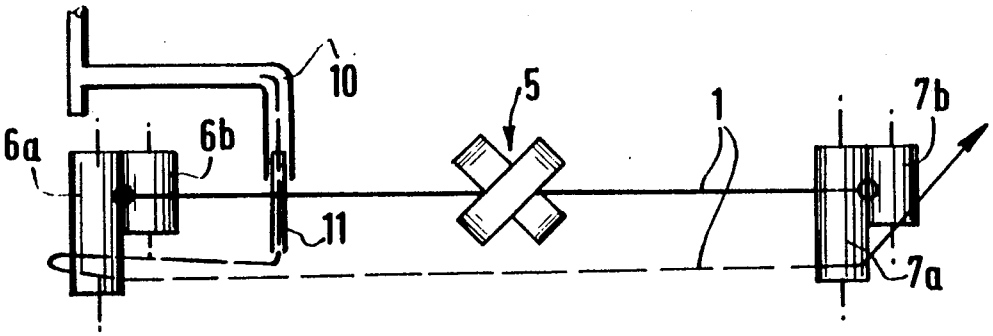
FIG. 2 is a diagrammatic top view of such a machine.

Lastly, as emerges from FIGS. 1 and 2 and the diagrams (6*a*–6*l*) illustrating the start-up procedure on a machine according to the invention, in each delivery roller system (6) and (7) one of the rollers (6*a*, 7*a*) is longer than the second roller (6*b*, 7*b*); moreover, in order to facilitate the introduction of the yarn between said rollers (6*a*, 6*b*), (7*a*, 7*b*), the latter may have a conical chamfer on their edge. In the attached drawings, such an embodiment of the rollers having a conical chamfer is illustrated in FIGS. 6*a* to 6*l* where the input pressing roller (6*b*) has such a feature. It could, of course, be envisaged for the other rollers of the delivery roller system also to be beveled.

As a result of such a machine structure, it is possible to carry out restart operations of a position in a particularly simple and rapid way, it being possible for this operation to be carried out either manually or, preferably, automatically.

Such a restart procedure, illustrated by FIGS. 6*a* to 6*l*, is as follows.

After shutting down the position, the bobbin (8), whatever its diameter, is lifted by a few millimeters above its drive cylinder (12) (see FIG. 4) and this is done as rapidly as possible in order to avoid "burying" the end of the yarn in the bobbin. The control (cam) unit (13) as well as the drive cylinder (12) may continue to function. The yarn delivery roller systems (6, 7) and the spindle (5) are simultaneously also shut down, the two belts (5*a*) (upper belt) and (5*b*) (lower belt) of said spindle (5) being spread apart.

The pressing rolls (6*b*, 7*b*) of the delivery roller systems (6, 7) remain in contact with the drive rolls (6*a*, 7*a*).

If necessary, if the position has been shut down in order to change bobbins, the removal of the full bobbin (8) is undertaken first and a bobbin, provided beforehand with a few meters of yarn, is placed between the forks of the winding system.

In a first stage (FIG. 6*a*) a previously formed length of yarn is taken up from the bobbin (8) by means of a suction gun (14) either manually or combined with a restart robot in order to bring it to the level of the entrance of the reserve (10), in other words, in the present case, towards the end orifice of the start-up jack (11) which is in the advanced position as illustrated in FIGS. 1 and 2.

The taking-up of the yarn from the bobbin (8) may be facilitated by applying a drive element (15) (see FIG. 4) against the surface of said bobbin enabling it to rotate in the reverse direction to its normal winding direction.

Figure 6A:
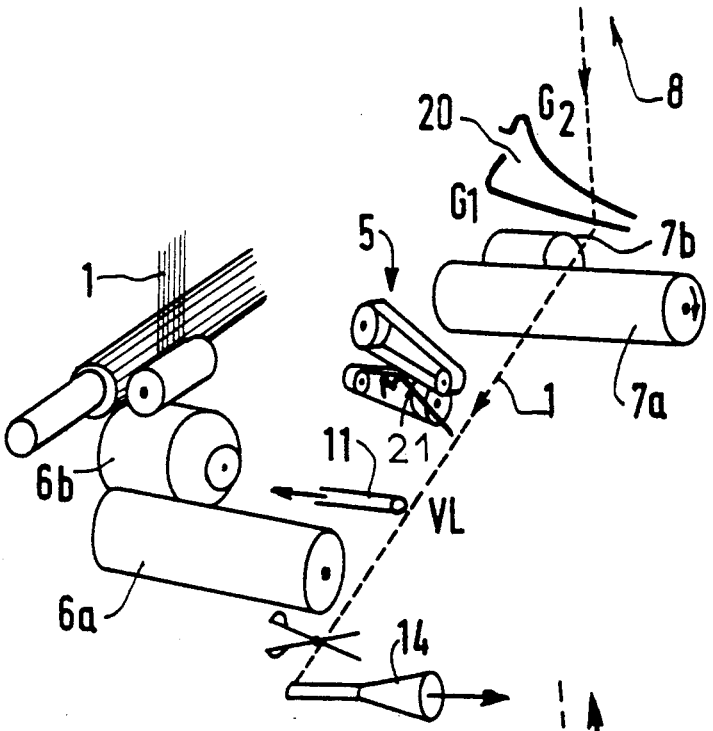
Figure 6B:
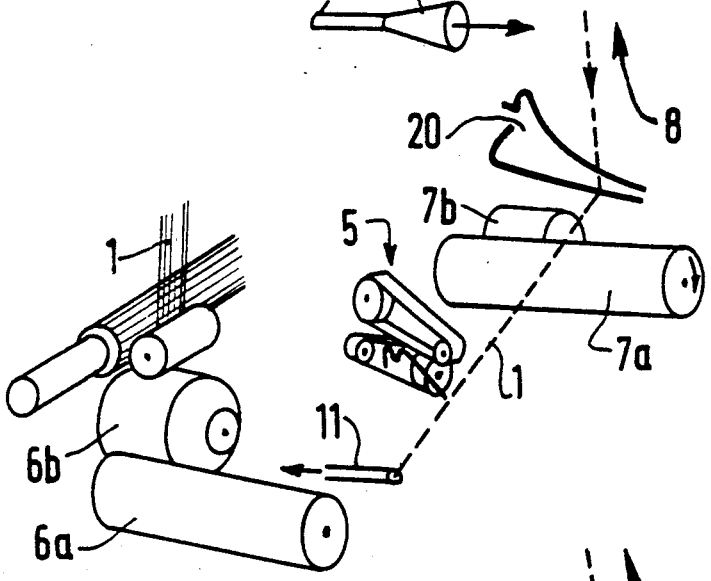
Figure 6C:
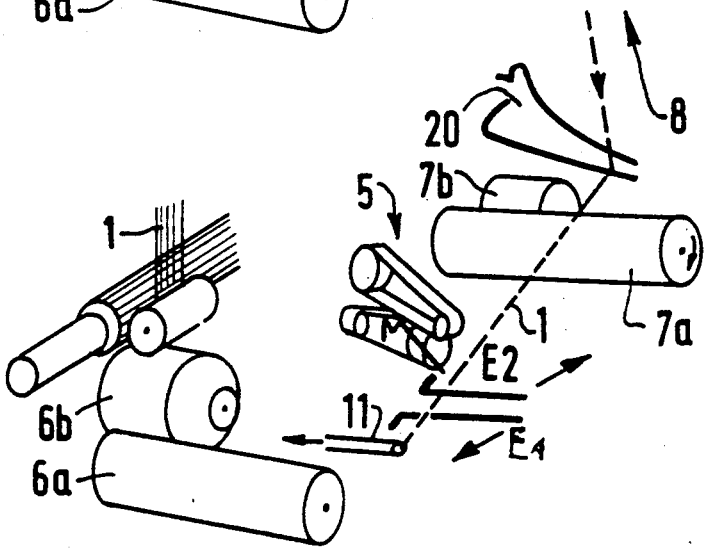
Figure 6D:
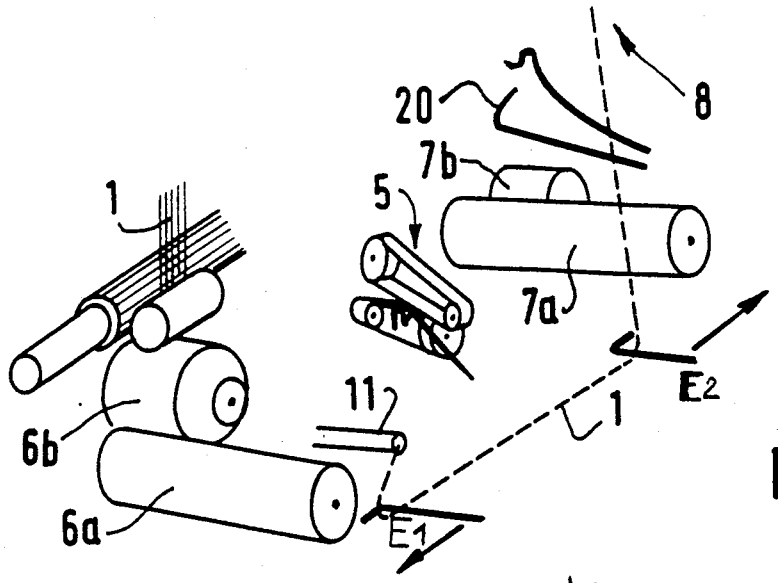
Figure 6E:
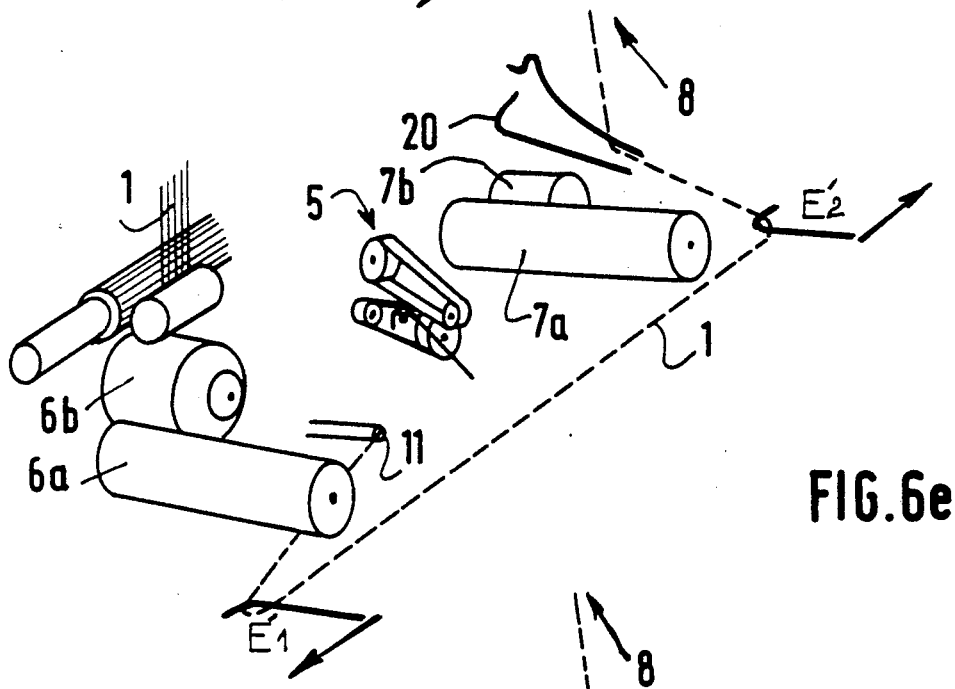
Figure 6F:
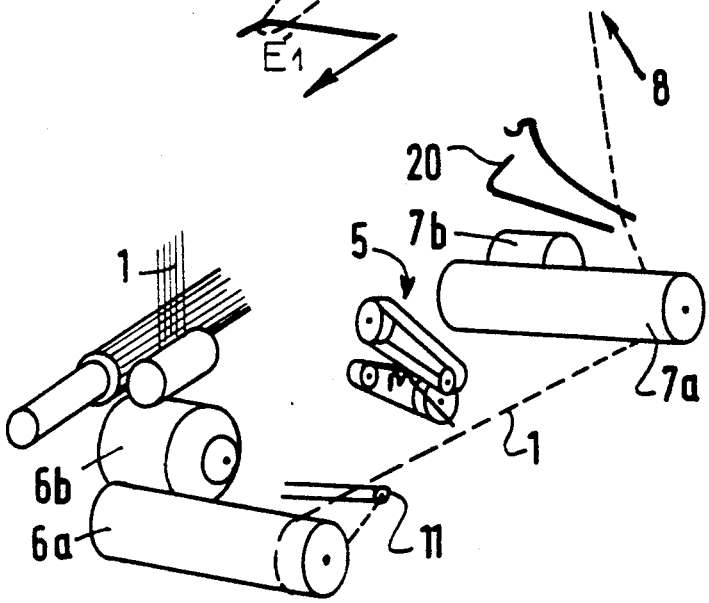

Once the yarn has been introduced inside the reserve (FIG. 6*b*) by means of a spreader unit (E1, E2), the portion of yarn between the end of the start-up jack (11) and the bobbin (8) is deviated (sequence illustrated by FIGS. 6*c*, 6*d*, 6*e*). In order to effect this taking-up of yarn from the receiving bobbin and the positioning relative to the cylinder (6*a*, 6*b*) of the delivery roller systems, a yarn-guiding element (20) is preferably arranged between the receiving bobbin (8) and the exit delivery roller system (7). The spreader devices E1, E2 therefore bring the yarn, in the form of a taut strand, into position E'1, E'2 (FIG. 3*b*or 6*e*) and this has the result that a loop of yarn is formed which surrounds the projecting ends of the drive shafts (6*a*, 7*a*) (FIGS. 6*f* and position shown in broken lines in FIGS. 1 and 2). Once this has been done, the procedure for reintroducing the portion of yarn thus held between the two drive shafts (6*a*, 7*a*) may be initiated.

Figure 6G:
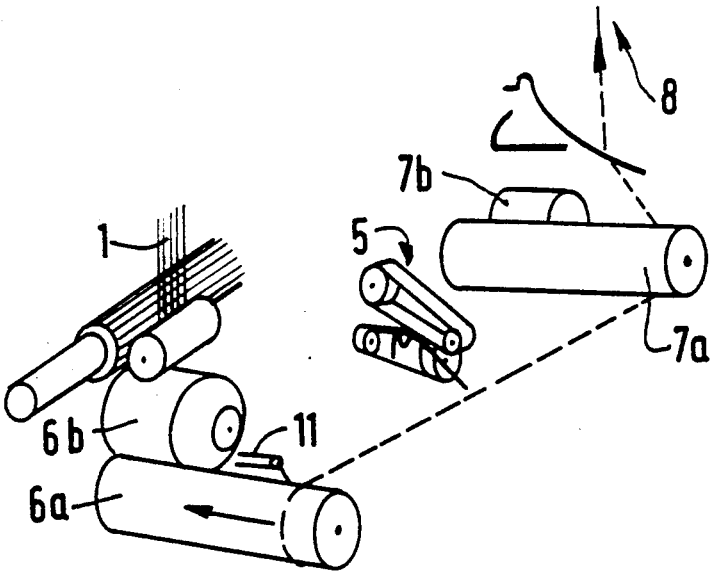
Figure 6H:
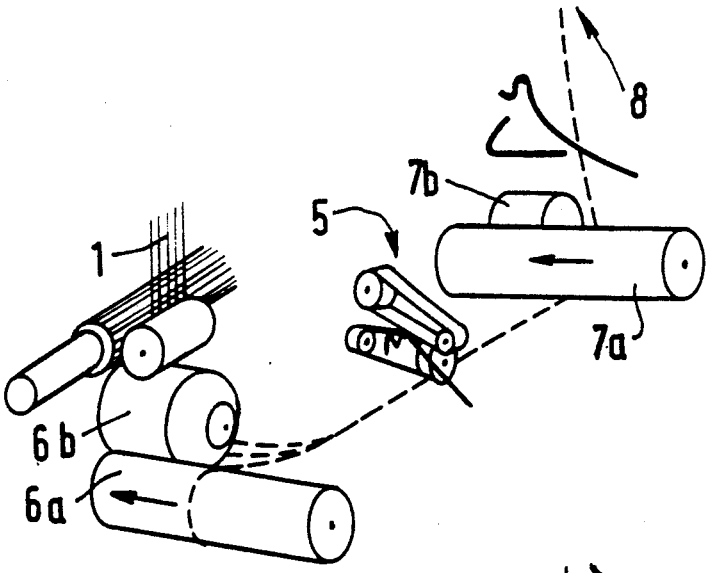
Figure 6I:
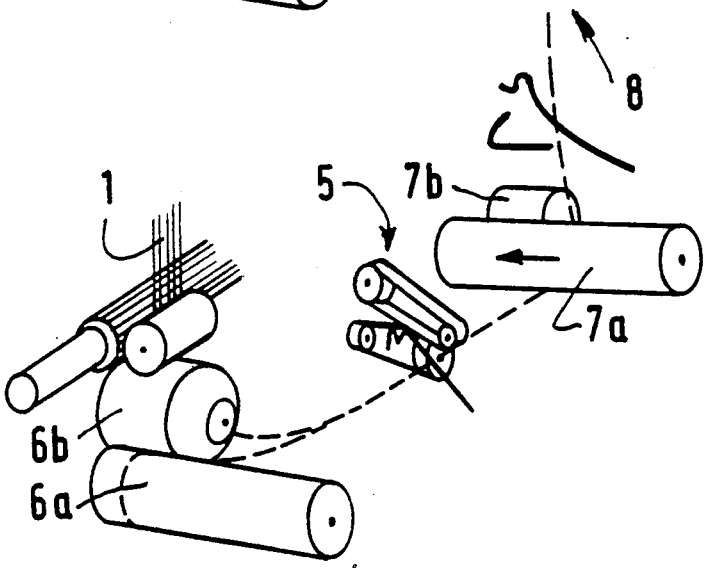
Figure 6J:
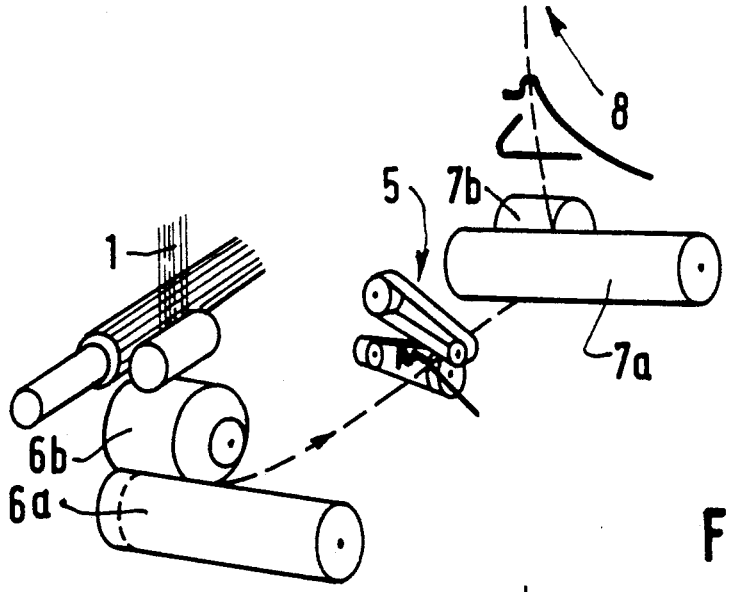
Figure 6K:
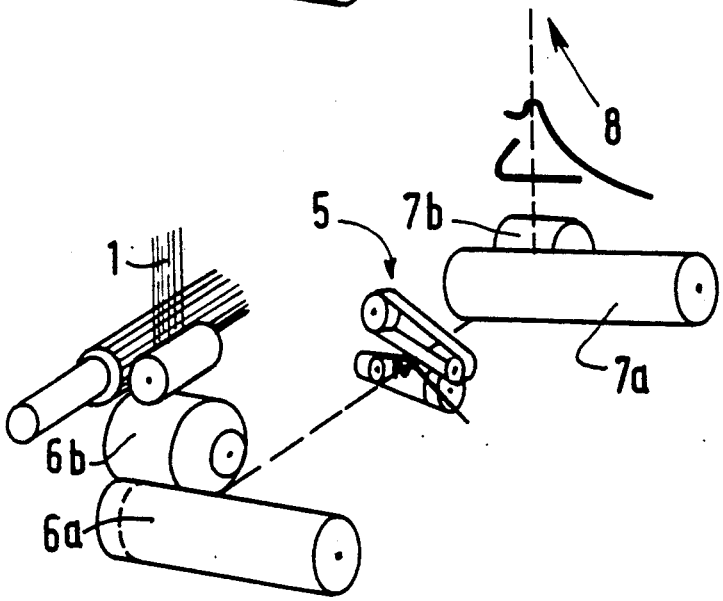
Figure 6L:
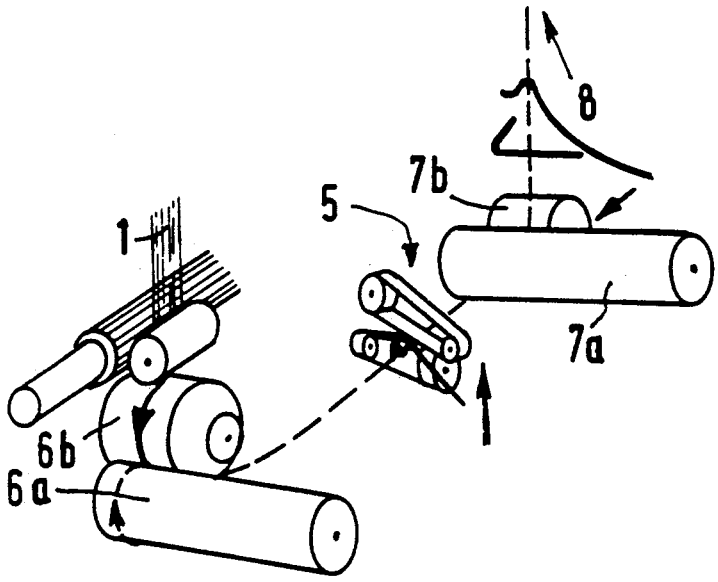

In order to do this, the start-up jack (11) is retracted which, in a first stage, produces a translational movement of the yarn on the shaft (6*a*) (FIG. 6*g*). Given the positioning of the start-up jack relative to the shaft (6*a*), the yarn begins by being introduced inside the first delivery roller system (6), which causes the portion of the yarn held between the two shafts to be displaced in a variable-pitch helical shape with an exponential movement of the yarn, allowing a virtually instantaneous introduction of the portion of yarn held taut inside the units formed by the members of the spinning block, this introduction taking place initially through the first delivery roller system (6) and then, virtually instantaneously, inside the treatment member proper (5) and inside the second delivery roller system (7).

In the case where the treatment member is a crossed-belt spindle, the introduction inside the spindle is facilitated by associating the latter with a ramp (21) positioned such that the yarn, when it is displaced, comes into contact with the belt (5*a*) of said spindle which facilitates the transverse displacement.

Simultaneously with this restart phase, the end of the yarn (1) (see FIG. 6*l*) to be treated is connected to a portion of the yarn placed in reserve when it passes around the roll (6*a*). Since the yarn is correctly positioned inside the various members of the spinning block, the spindle (5) may then be closed and the pressing roll (6*b*) which had previously been separated from the drive roll (6*a*) is then re-engaged for normal functioning.

Such a machine design therefore enables the restart to be carried out rapidly, accurately and at high speed, and also in an entirely automatable manner and is equally suitable for equipment enabling fibers to be treated (for example spinning equipment employing false twisting spindles or any other similar equipment) as for equipment for treating continuous filaments such as texturing machines, in particular false twisting texturing machines, it being necessary for the heater associated with the spindle to be designed, as mentioned above, so as to enable the yarn to be treated to be introduced laterally by translation in the form of a taut strand.

What is claimed is:

1. In a yarn processing machine having a supply of yarn to be processed positioned upstream of input and output delivery feed roller systems, mounted on either side of a treatment block to form therewith a spinning plane, and a winding/storage reel system positioned downstream from said output feed roller system; means for automatically starting up the feeding of yarn through the machine comprising:

vacuum operated temporary storage means positioned below said spinning plane between said input and output delivery feed roller systems;

a small supply of processed yarn wound on said winding/ storage reel positioned downstream of said second delivery feed roller system;

means for introducing the free end of said small supply of processed yarn on said winding/storage reel into said vacuum operated temporary storage means;

guide wire means for forming a loop of processed yarn from said winding/storage reel and temporary storage means about said input and output delivery feed roller systems; and means for causing said loop of yarn to move axially along the input and output feed delivery roller systems into the treatment block therebetween to pick up the yarn to be processed and carry it through the treatment block to the output feed delivery roller system and to the winding/storage reel for rewinding after processing.

2. The apparatus as claimed in claim 1 wherein said input and output delivery feed roller systems each include a pair of feed rollers, one being a drive roller and the other a pressing roller, mounted in surface contact for feeding of a strand of yarn therebetween; and the drive roller of each of said pairs of rollers being longer than the other to facilitate introduction of the yarn therebetween.

3. The apparatus as described in claim 2 wherein at least the pressing roller of the input delivery feed roller system has a conical taper on its outer end for facilitating the introduction of the yarn between said delivery roller pair of the feed roller system.

4. The apparatus as described in claim 1 wherein said temporary storage means comprises a suction tube having a slidably mounted yarn receiving tube therein, said slidably mounted tube being adapted to receive therein the free end of the small quantity of yarn stored on the winding/storage reel when it is desired to start up the feeding of yarn through the processing system.

5. In a machine for performing various finishing operations on yarn having a supply of yarn to be processed, positioned upstream of input and output delivery feed roller systems, mounted on either side of a processing and finishing section, and a winding/storage reel system positioned downstream of said output feed roller system; the method of starting up the feeding of yarn from the input rollers to the output rollers through the processing and finishing section which includes the steps of:

providing a small quantity of processed yarn on the winding/storage reel;

feeding the free end of the previously processed yarn from the winding/storage reel system back past the processing and finishing section into a temporary storage device positioned below and between said input and output delivery roller systems;

causing the yarn drawn from the winding/storage reel system to form a loop around the input and output delivery feed roller systems;

drawing the previously processed yarn loop taut between the input and output feed roller systems and displacing it axially inwardly into the yarn processing and finishing section; and causing said previously processed yarn loop to pick up the free end of the yarn to be processed as the yarn from the temporary storage device is fed about the input delivery feed rollers through the processing and finishing section and output delivery feed roller system to the winding/storage reel system.

6. The method of claim 5 further including picking up the free end of the previously processed yarn on the winding/storage reel with a suction gun, directing it around the output and input delivery feed rollers to the entrance of the temporary yarn storage device and releasing it thereto.

7. The method of claim 5 further including engaging the free end of the previously processed yarn on the winding/storage reel system in a guide wire means; and automatically causing the guide wire means to loop the previously processed yarn about the input and output delivery feed roller systems for axial displacement into the main feeding path.

* * * * *